US007446713B2

(12) United States Patent
Kim

(10) Patent No.: US 7,446,713 B2
(45) Date of Patent: Nov. 4, 2008

(54) ANTENNA OF MOBILE COMMUNICATION TERMINAL HAVING ASSISTANCE RADIATOR

(75) Inventor: Byung Nam Kim, Gyeonggi-do (KR)

(73) Assignee: Pantech Co., Ltd., Seoul (KR)

( * ) Notice: Subject to any disclaimer, the term of this patent is extended or adjusted under 35 U.S.C. 154(b) by 138 days.

(21) Appl. No.: 11/249,232

(22) Filed: Oct. 13, 2005

(65) Prior Publication Data

US 2006/0145933 A1 Jul. 6, 2006

(30) Foreign Application Priority Data

Jan. 6, 2005 (KR) ..... 10-2005-0001222

(51) Int. Cl.
*H01Q 1/24* (2006.01)
*H01Q 1/38* (2006.01)

(52) U.S. Cl. ..... 343/702; 343/828; 343/873

(58) Field of Classification Search ..... 343/700 MS, 343/702, 752, 895, 828, 873
See application file for complete search history.

(56) References Cited

U.S. PATENT DOCUMENTS 6,124,831 A 9/2000 Rutkowski et al. ..... 343/700
6,677,905 B2 * 1/2004 Deguchi et al. ..... 343/702
2003/0076264 A1 4/2003 Yuanzhu ..... 343/700

FOREIGN PATENT DOCUMENTS

EP 0869579 12/2005
JP 2004-228984 8/2004

* cited by examiner

*Primary Examiner*—Michael C Wimer
(74) *Attorney, Agent, or Firm*—Ohlandt, Greeley, Ruggiero & Perle, L.L.P.

(57) ABSTRACT

An antenna of a mobile communication terminal has a plate-shaped dielectric; a conductor line formed to the dielectric and having a leading end connected to a transceiving section of the mobile communication terminal and a terminal end extendingly formed into a shape curved from the leading end and located at a middle part of the plate-shaped dielectric; and an assistance radiator electrically connected to the terminal end of the conductor line and mounted to surround the plate-shaped dielectric. According to the antenna, since there is provided the assistance radiator, it is possible to shorten the length of the antenna while maintaining the overall length of the conductor line to be same and to improve the average radiation gain of the antenna.

7 Claims, 8 Drawing Sheets

ANTENNA OF MOBILE COMMUNICATION TERMINAL HAVING ASSISTANCE RADIATOR

CROSS-REFERENCE TO RELATED APPLICATIONS

This application claims all benefits of Korean Patent Application No. 10-2005-0001222 filed on Jan. 6, 2005 in the Korean Intellectual Property Office, the disclosures of which are incorporated herein by reference.

BACKGROUND OF THE INVENTION

1. Field of the Invention

The present invention relates to an antenna of a mobile communication terminal, and more particularly to an antenna of a mobile communication terminal capable of maintaining a length of a required conductor line and improving the average radiation gain of the antenna even when a length of the antenna is structured to be short.

2. Description of the Prior Art

In recent years, as a mobile communication terminal such as cellular phone and PDA phone has been widely used, an antenna for the mobile communication terminal, which receives/transmits radio waves, has made remarkable progress. In the drawings, FIG. 1 is a schematic view of a helical antenna of a mobile communication terminal having a main radiator according to the prior art, and FIG. 2 is a schematic view of a PCB type antenna of a mobile communication terminal having a main radiator according to the prior art.

As shown in FIG. 1, a helical antenna 10, which is an external antenna, comprises a metal part 11 supplying a signal to the antenna 10, a coil 13 connected to the metal part 11 and determining a resonance property of the antenna 10, and a plastic injection 15 surrounding and fixing the coil 13.

A resonance of the antenna occurs by a pitch (P) of the coil 13 and a relative dielectric constant of a plate-shaped dielectric that is the plastic injection 15 and the resonance property of the antenna appears at bands of 900 MHz and 1,800 MHz.

In the mean time, as shown in FIG. 2, a PCB type antenna 20, which is an external antenna, comprises a plate-shaped dielectric 23 and a conductor line 21 which is formed into a continuously curved shape on an upper part of the plate-shaped dielectric 23, and is mounted to an exterior of a mobile communication terminal with being surrounded by a plastic injection (not shown).

Since the above external antennas are outwardly protruded from the mobile communication terminal, it is very inconvenient for a user to carry it. Accordingly, in order to solve the inconvenience, a length of the external antenna should be shortened to the utmost.

There is no choice but to reduce the pitch (P) so as to shorten the length of the antenna while maintaining a length of the coil or conductor line according to frequency bands. However, the emissivity of the antenna is determined by the pitch of the coil and the conductor line. Accordingly, when the pitch (P) of the coil or conductor line is reduced so as to shorten the length of the antenna, the emissivity is proportionally decreased and thus it is impossible to obtain a desired property of the antenna.

In addition, ends of the coil of the above helical antenna and the conductor line of the PCB type antenna are located at an upper end of the antenna. With the mobile communication terminal having the prior external antenna, when a user grasps the mobile communication terminal and performs a call, the end of the antenna is surrounded or screened by a hand or object in many cases. Since charges are concentrically gathered at the end of the antenna, radiation of electromagnetic waves is hindered when the end of the antenna is screened. In addition, a property of a stationary wave is drastically decreased due to movement of a resonant frequency at GSM900 or GSM850 having a relatively narrow bandwidth.

SUMMARY OF THE INVENTION

Accordingly, the present invention has been made to solve the above problems of the prior art. An object of the present invention is to provide an antenna of a mobile communication terminal of which an overall length can be structured to be short while maintaining a pitch (P) to be same and having an assistance radiator structured to maintain a property of a stationary wave even when a portion of the antenna is screened by an object.

In order to achieve the above object, there is provided an antenna of a mobile communication terminal according to an embodiment of the invention comprising: a plate-shaped dielectric; a conductor line formed to the dielectric and having a leading end connected to a transceiving section of the mobile communication terminal and a terminal end extendingly formed into a shape curved from the leading end; an assistance radiator electrically connected to the terminal end of the conductor line and mounted to surround the plate-shaped dielectric; and a housing which partially or completely covers the plate-shaped dielectric, the conductor and the assistance radiator from the outside.

The conductor line may be formed on a surface of the plate-shaped dielectric. In the case, the assistance radiator may be made of a plate-shaped conductive material having a shape surrounding a predetermined portion of the dielectric and mounted to be spaced from the plate-shaped dielectric at a predetermined distance. In addition, the terminal end of the conductor line may be formed with a through-hole passing through the plate-shaped dielectric and a connection piece formed on an opened end of the assistance radiator passes through the through-hole to electrically connect with the other end of the conductor line.

In order to achieve the above object, there is provided an antenna of a mobile communication terminal according to an another embodiment of the invention comprising: a bar-shaped dielectric; a conductor line which is embedded in the bar-shaped dielectric to function as a radiator; an assistance radiator which is mounted on the bar-shaped dielectric to surround a predetermined portion of the bar-shaped dielectric; and a housing which partially or completely covers the bar-shaped dielectric, the conductor line and the assistance radiator from the outside.

In addition, the conductor line may be exposed to an exterior by a hole formed on a surface of the bar-shaped dielectric, and a connection piece formed on an opened end of the assistance radiator is inserted into the hole to electrically connect with the terminal end of the conductor line.

In the mean time, the assistance radiator may be removably mounted on the bar-shaped dielectric.

In order to achieve the above object, there is provided a mobile communication terminal having an antenna, wherein the antenna comprises a bar-shaped dielectric, a conductor line which is embedded in the bar-shaped dielectric to function as a radiator, an assistance radiator which is mounted on the bar-shaped dielectric to surround a predetermined portion of the bar-shaped dielectric and a housing which partially or completely covers the bar-shaped dielectric, the conductor line and the assistance radiator from the outside.

When using the antenna of the mobile communication terminal according to the invention, it is possible to reduce an overall length thereof to easily carry it and to improve a radiation gain of the antenna.

In addition, since the antenna of the mobile communication terminal has a widened area corresponding to an end of the antenna, an average radiation gain of the antenna is not decreased even when a portion of the antenna is screened or a user grasps the mobile during the call.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. In the following description of the present invention, a detailed description of known functions and configurations incorporated herein will be omitted when it may make the subject matter of the present invention rather unclear.

Figure 3:
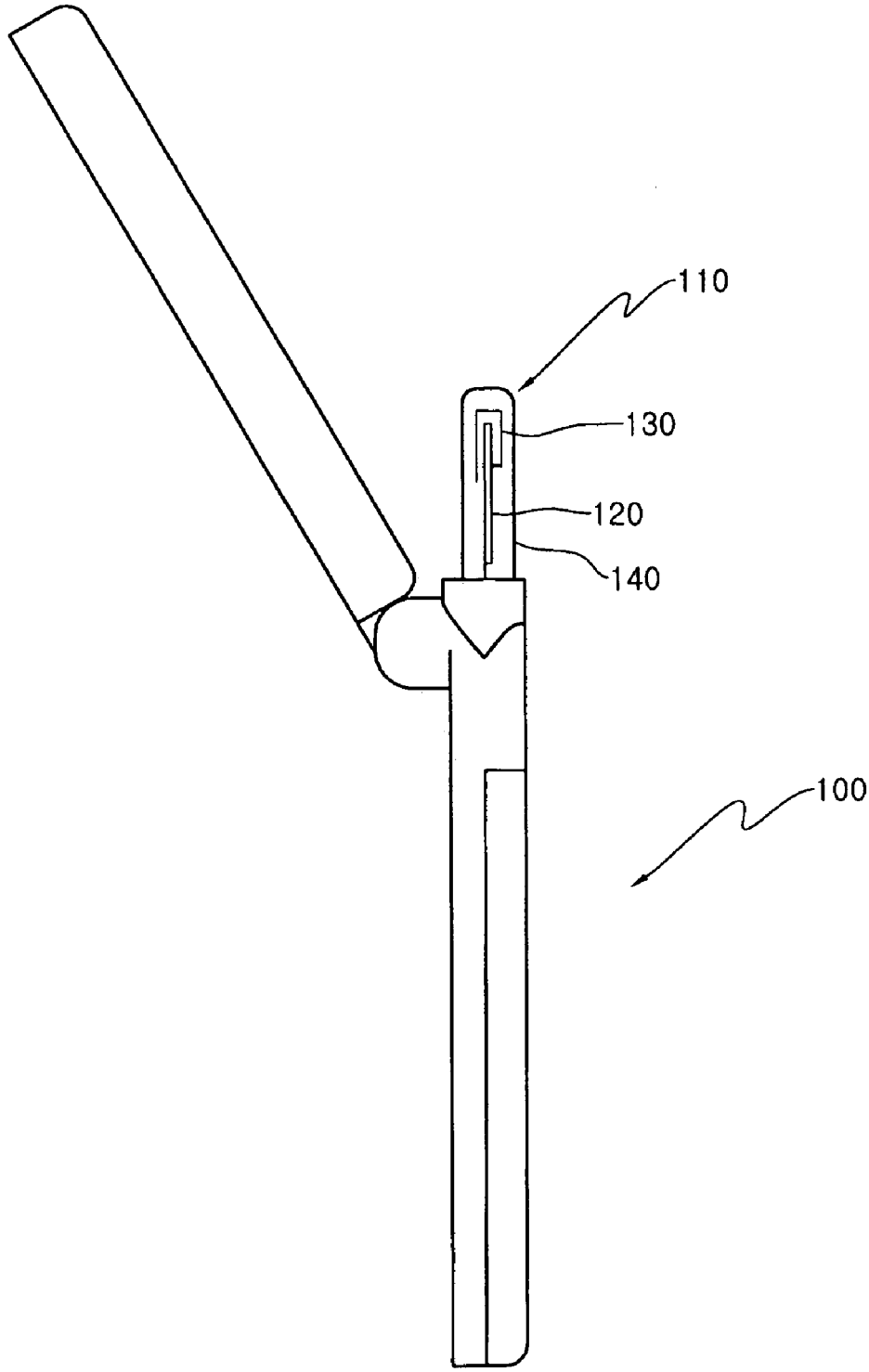
FIG. 3 is a schematic view showing a situation that an antenna having an assistance radiator according to a preferred embodiment of the invention is mounted to a mobile communication terminal.

FIG. 3 is a schematic view showing a situation that an antenna 110 having an assistance radiator 130 according to a preferred embodiment of the invention is mounted to a mobile communication terminal 100.

Referring to FIG. 3, the antenna 110 according to an embodiment of the invention comprises a main radiator 120 connected to a transceiving section (not shown) of the mobile communication terminal 100, and an assistance radiator 130 formed to surround a terminal end of the main radiator 120. The main radiator 120 and the assistance radiator 130 are surrounded by a housing 140 and mounted to an upper part of the mobile communication terminal 100 to be directed toward a folder of the terminal. Like this, when the assistance radiator 130 is located to be directed toward the terminal, since a user's finger cannot access to the assistance radiator 130, the antenna 110 can easily radiate an electromagnetic wave without obstruction. Hereinafter, a structure of the antenna 110 according to an embodiment of the invention will be specifically described with reference to Figs.

Figure 4:
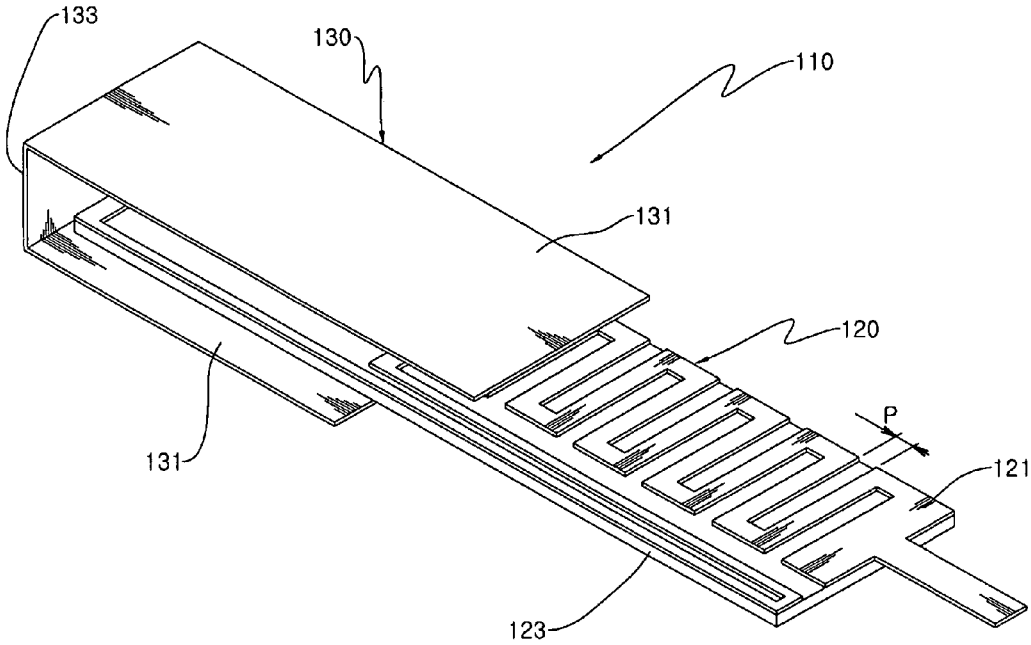
FIG. 4 is a perspective view showing the antenna in FIG. 3.

FIG. 4 is a perspective view showing an antenna according to a preferred embodiment of the invention.

Referring to FIG. 4, the antenna 110 of the invention comprises the main radiator 120 and the assistance radiator 130 connected to a conductor line 121 of the main radiator 120 and mounted to surround the main radiator 120, and the housing (140 in FIG. 3) as described above.

The main radiator 120 comprises a plate-shaped dielectric 123 and a conductor line 121 formed on a surface of the plate-shaped dielectric 123. The conductor line 121 is formed into a continuously curved shape wherein a leading end of the conductor line 121 is connected to a transceiving section of the mobile communication terminal (100 in FIG. 3) and a terminal end of the conductor line 121 is extendingly formed into a shape curved from the leading end. The housing 140 covers the plate-shaped dielectric 123, the conductor line 121 and the assistance radiator 130 partially or completely.

Figure 5:
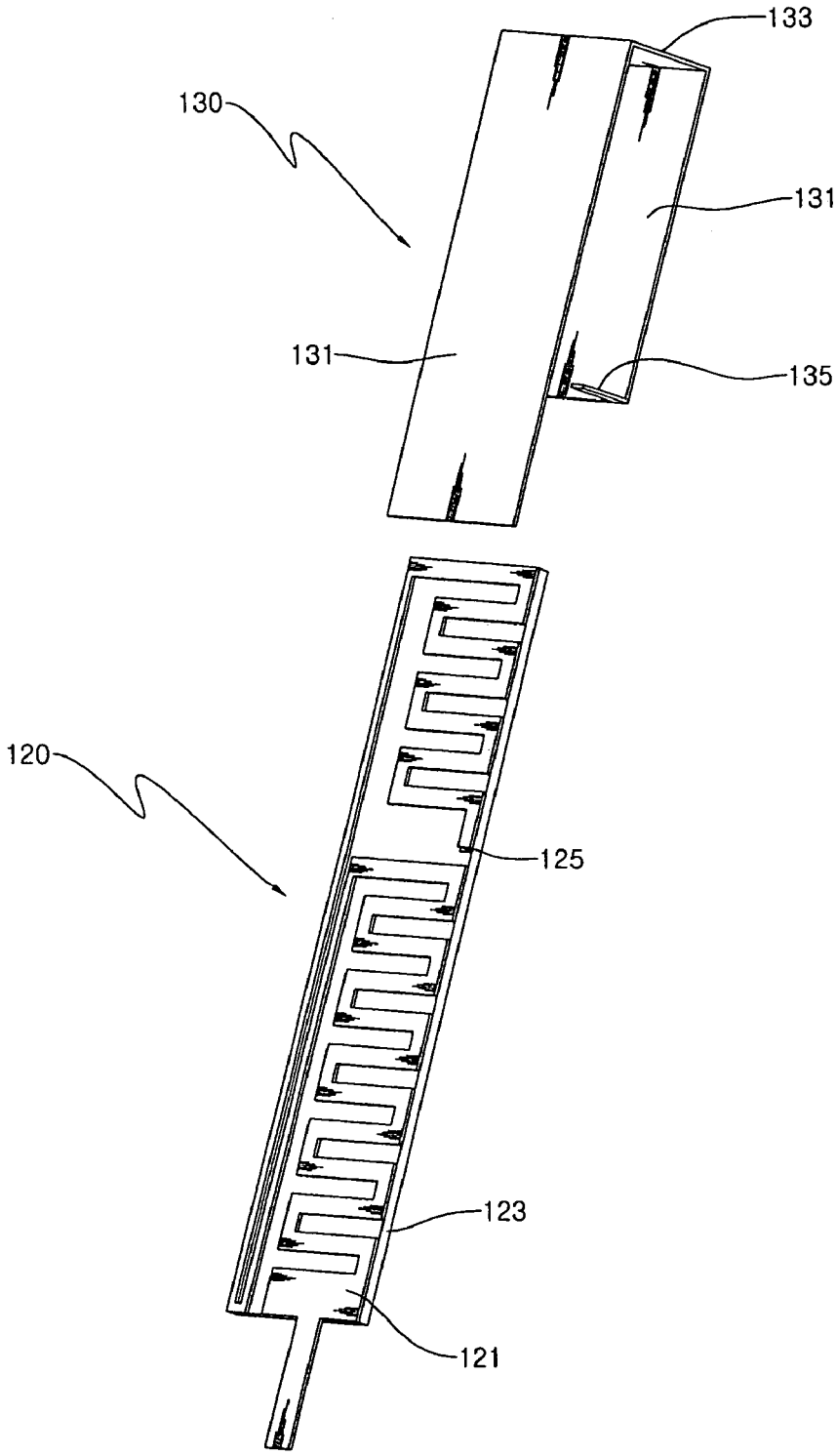
FIG. 5 is an exploded perspective view of the antenna in FIG. 4.

FIG. 5 is an exploded perspective view of the antenna shown in FIG. 4, in which the structures of the main radiator 120 and the assistance radiator 130 are more clearly shown.

Referring to FIG. 5, the conductor line 121 of the main radiator 120 is connected to the transceiving section of the mobile communication terminal (100 in FIG. 3) at a lower end of the drawing and extended to a longitudinal middle part along a surface of the plate-shaped dielectric 123 with a continuously curved form. The conductor line 121 is extended toward a side of the plate-shaped dielectric 123 from the middle part of the plate-shaped dielectric 123, and curved and extended from the side to a lower end of the plate-shaped dielectric 123. The conductor line 121 having reached the lower end of the plate-shaped dielectric 123 is again curved and extended toward an upper end of the plate-shaped dielectric 123. The conductor line 123 having reached the upper end of the plate-shaped dielectric 123 is again continuously curved downward. According to the structure of the conductor 1line 121 as described above, the terminal end of the conductor line 121 is located at the middle of the plate-shaped dielectric 123.

In the mean time, according to a preferred embodiment of the invention, the assistance radiator 130 has a plate structure and a shape surrounding a predetermined portion of dielectric 123, especially a terminal end of the dielectric 123. The assistance radiator 130 is folded twice at a longitudinal middle part thereof, so that it has a 'U' shape comprising two symmetrical surfaces 131 opposite to each other and a closing surface 133 connecting the two symmetrical surfaces 131. In addition, the assistance radiator 130 has a connection piece 135 at an opened end of any one of the two symmetrical surfaces 131. The connection piece 135 serves to connect with the terminal end of the conductor line 121 by passing through the plate-shaped dielectric 123 via a through-hole 125 formed at the terminal end of the conductor line 121 of the main radiator 120.

Accordingly, the main radiator 120 is spaced from the assistance radiator 130 at a predetermined distance and located to be parallel with the two symmetrical surfaces 131 of the assistance radiator 130 between the symmetrical surfaces 131. The connection piece 135 formed at the opened end of the symmetrical surface 131 is connected to the terminal end of the conductor line 121 via the through-hole 125 of the main radiator 120. With such a structure, the conductor line 121 of the main radiator 120 is electrically connected to the assistance radiator 130, so that a terminal end of the antenna 110 radiating electromagnetic waves is extended to an edge of the assistance radiator 130, rather than to an end of the conductor line 121. Like this, when the terminal end of the antenna 110 is extended to have a certain form rather than a point form, it is more efficient to radiate the electromagnetic waves.

Figure 6:
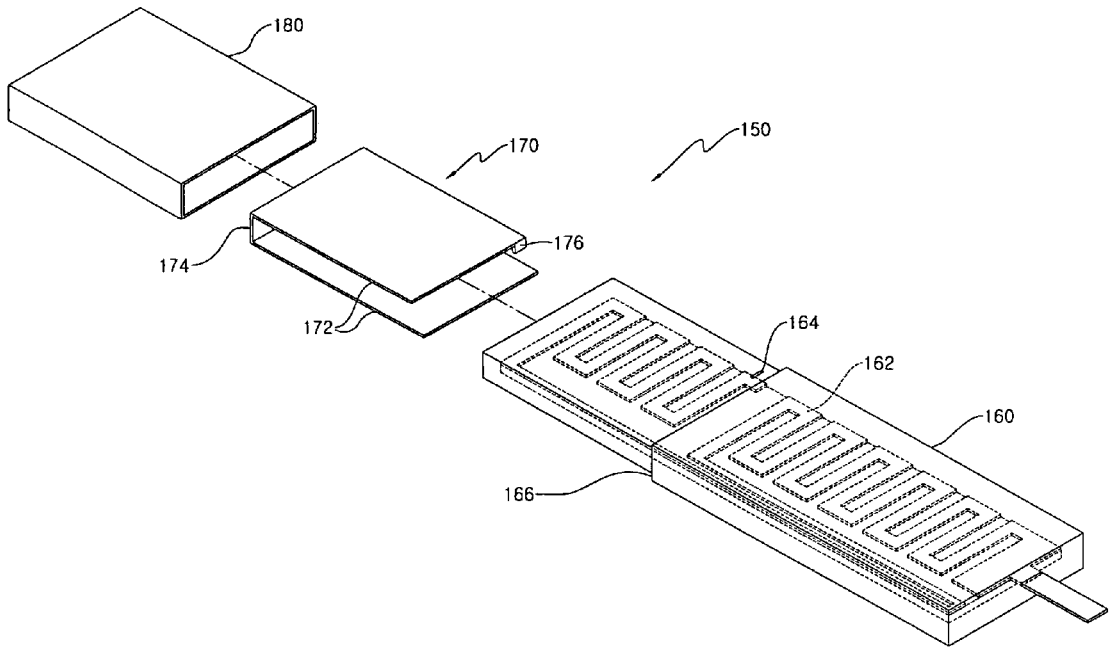
FIG. 6 is a perspective view showing a antenna having an assistance radiator according to a preferred another embodiment of the invention.

FIG. 6 is a perspective view showing a preferred another embodiment of the invention.

Referring to FIG. 6, an antenna 150 according to this embodiment is different form the embodiment shown in FIG. 4 in that the dielectric has a bar shape and a conductor line 162 is embedded in the bar-shaped dielectric 160. Hereinafter, the invention will be described on the basis of the differences.

As shown in FIG. 6, the dielectric 160 according to this embodiment has a bar shape. The dielectric 160 is bar-shaped, so that it has a volume in which the conductor line 162 can be embedded therein. An engaging step 166 is formed along a periphery at a middle part of the dielectric 160. An assistance radiator 170 and a housing 180 that will be described later are engaged to the engaging step 166 at ends thereof, so that the assistance radiator 170 and the housing 180 are located at correct positions.

The conductor line 162 is formed into a continuously curved shape with it being embedded in the dielectric 160, wherein a terminal end of the conductor line 162 is located in a middle part of the dielectric 160. The arrangement of the conductor line 162 is similar to that of the embodiment shown in FIG. 4. Accordingly, detailed descriptions thereof will be omitted. Like this, according to this embodiment, since the conductor line 162 is not exposed to an exterior of the dielectric 160, the assistance radiator 170 can be mounted with it being contacted with the dielectric 160.

The assistance radiator 170 has a shape surrounding a predetermined portion of the bar-shaped dielectric 160, especially a terminal end of the dielectric 160 and is folded twice at a longitudinal middle part, thereby forming a 'U' shape comprising two symmetrical surfaces 172 opposite to each other and a closing surface 174 connecting the two symmetrical surfaces 172. The assistance radiator 170 includes a connection piece 176 at an opened end of any one of the two symmetrical surfaces 172.

Preferably, the assistance radiator 170 is made of an elastic material to allow the symmetrical surfaces 172 to apply an elastic force toward an interior of the 'U' shape. Accordingly, when the end of the dielectric 160 is inserted into the 'U' shaped assistance radiator 170, the assistance radiator 170 is connected to the dielectric 160 without separation due to the elastic force applied toward the interior of the symmetrical surfaces 172. In this case, since the conductor line 162 is embedded in the bar-shape dielectric 160, the assistance radiator 170 can be mounted with it being contacted to the dielectric 160. In the mean time, leading ends of the symmetrical surfaces 172 of the assistance radiator 170 are engaged to the engaging step 166 formed at the dielectric 160, thereby allowing the assistance radiator 170 to be located at a correct position. When it is desired to separate the assistance radiator 170 from the dielectric 160, a force is applied to the symmetrical surfaces 172 of the assistance radiator 170 outward, thereby widening the symmetrical surfaces 172 and thus separating the assistance radiator 170 from the dielectric 160.

In the mean time, a hole 164 is formed at a position of the bar-shaped dielectric 160 corresponding to the terminal end of the conductor line 162, so that the terminal end of the conductor line 162 is exposed to the exterior. Accordingly, when the assistance radiator 170 is mounted to the dielectric 160, the connection piece 176 of the assistance radiator 170 is inserted into the hole 164 to electrically contact with the conductor line 162.

The housing 180 covers the bar-shaped dielectric 160, the conductor line 162 and the assistance radiator 170 partially or completely. The housing 180 has a hexahedral shape having an end opened and includes an internal space into which the dielectric 160 and the assistance radiator 170 are inserted partially or completely. The opened end of the housing 180 is engaged to the engaging step 166 of the dielectric 160 and thus located at a correct position.

Like this, when the assistance radiator 170 is mounted with being contacted to the dielectric 160 without being spaced from the dielectric 160, it is possible to easily manufacture it and to form a more solid structure. Although a connection structure of the assistance radiator and the conductor line is exemplified in the above descriptions, the connection stricture is not limited to the example and can be properly changed by a skilled in that art without departing from a scope of the invention.

Comparing the antenna 110 having the assistance radiator 130 according to the invention with the antenna of the prior art, there is no large difference between lengths of the conductor lines of the main radiators per an area. However, since the antenna 110 according to an embodiment of the invention has the assistance radiator 130 connected to the conductor line 121 of the main radiator 120, a shortened length of the conductor line 121 is compensated by the length of the assistance radiator 130 even when the length of the plate-shaped dielectric 123 is shortened. Accordingly, the antenna 110 according to an embodiment of the invention can have an equal or more superior performance, even when a length thereof is shortened compared to the prior antenna.

Figure 1:
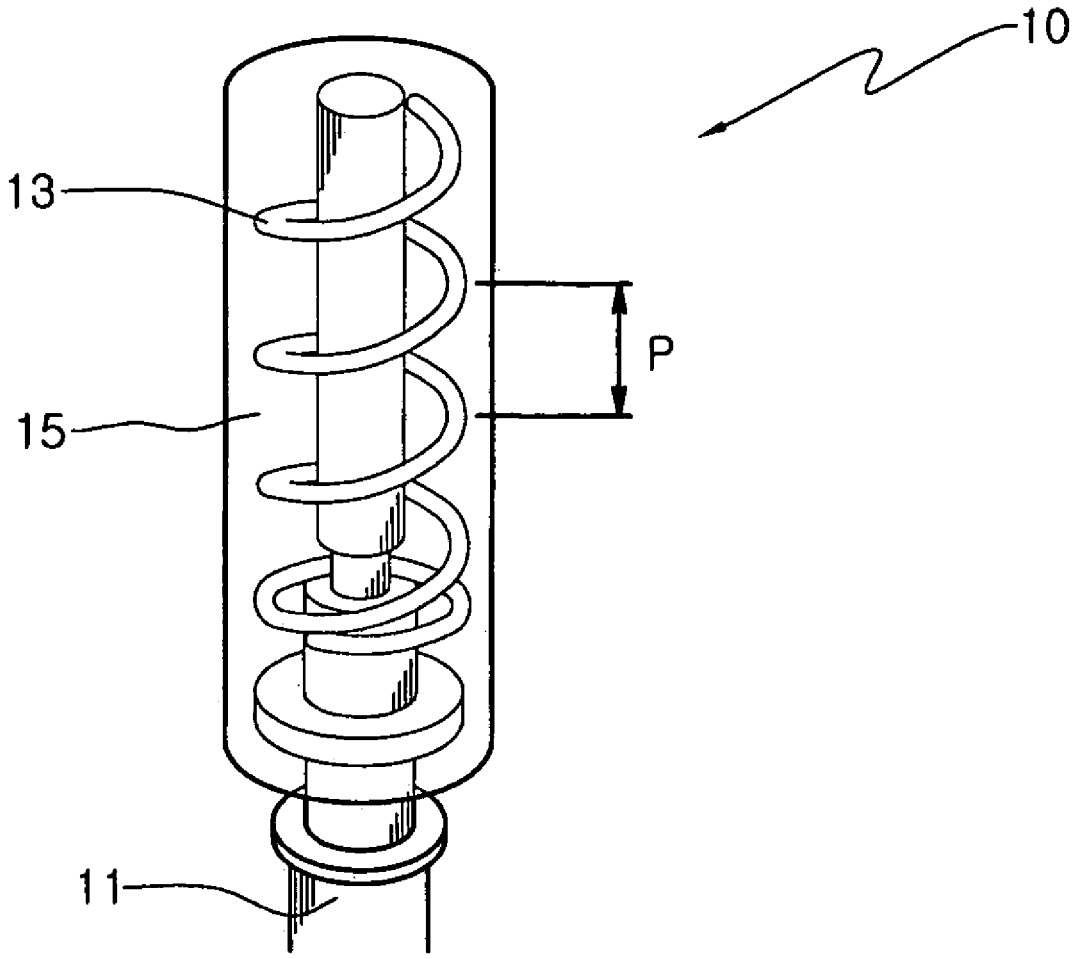
FIG. 1 (Prior Art)
FIG. 1 is a schematic view of a helical antenna of a mobile communication terminal having a main radiator according to the prior art.
Figure 2:
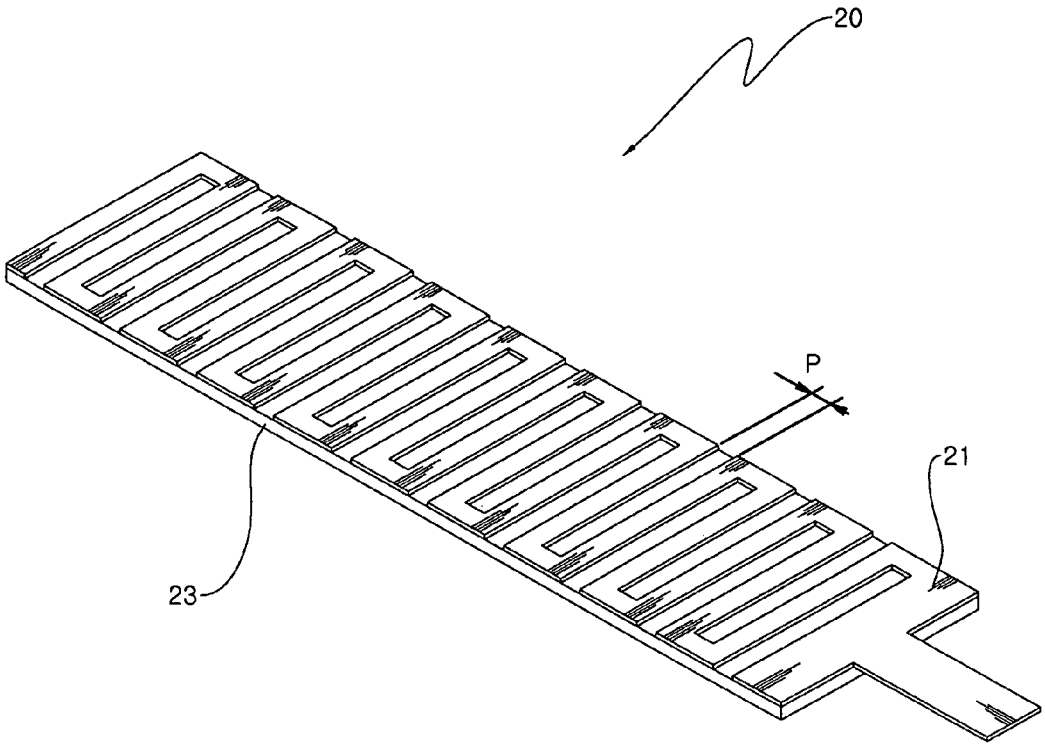
FIG. 2 (Prior Art)
FIG. 2 is a schematic view of a PCB type antenna of a mobile communication terminal having a main radiator according to the prior art.

In the mean time, while an end of the conductor line 21 of the antenna (20 in FIG. 2) according to the prior art is formed at the upper end of the antenna 20, an end of the antenna 110 having the assistance radiator of the invention is formed at the edge of the assistance radiator 130. Accordingly, the area corresponding to the end of the conductor line is widened, so that the radiation gain of the antenna is always high without an effect even when a portion of the antenna is screened.

Figure 7A:
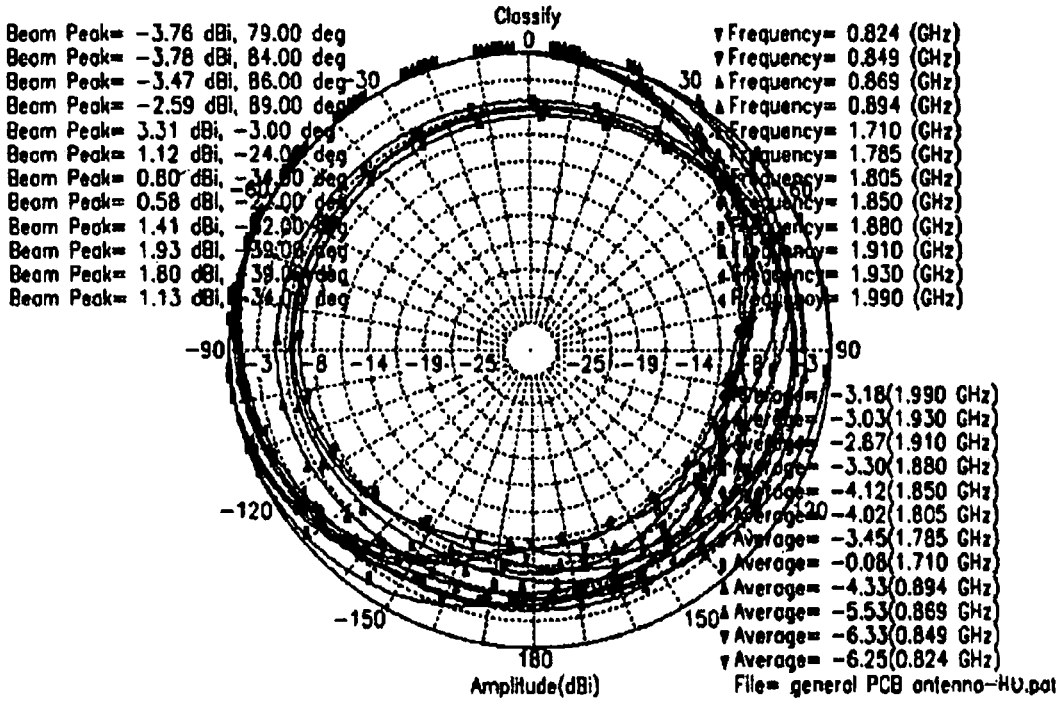
FIG. 7A is a graph showing a radiation pattern of an antenna according to the prior art.
Figure 7B:
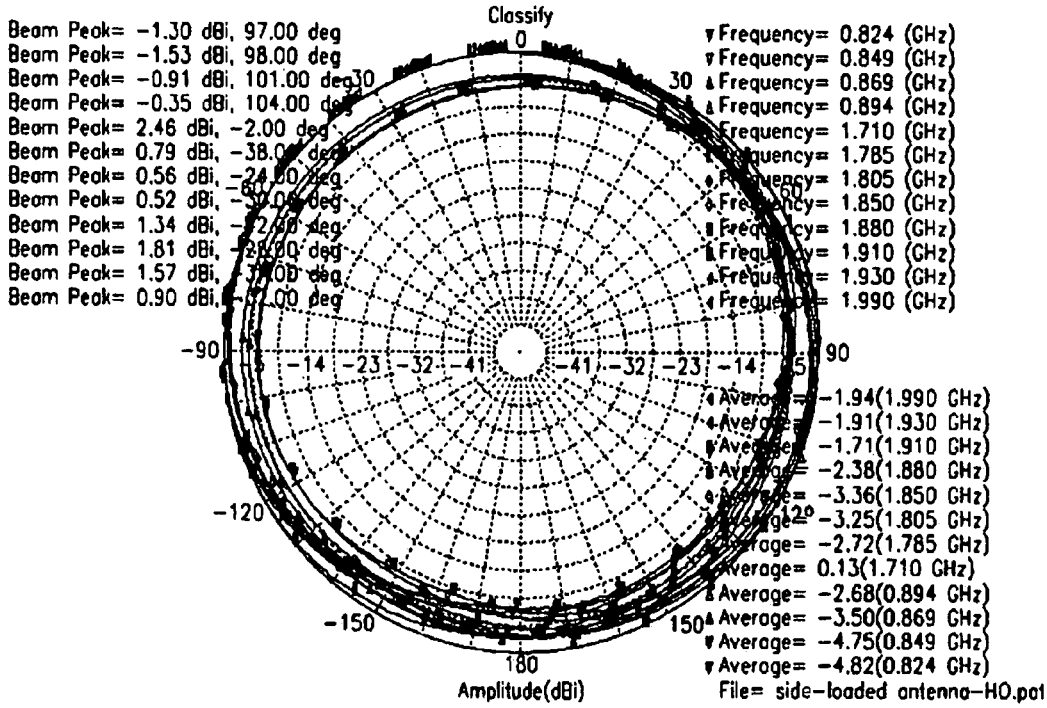
FIG. 7B is a graph showing a radiation pattern of an antenna according to an embodiment of the invention.

FIG. 7A is a graph showing a radiation pattern of an antenna according to the prior art, and FIG. 7B is a graph showing a radiation pattern of an antenna according to an embodiment of the invention.

As shown in FIGS. 7A and 7B, it can be seen that the radiation pattern of the antenna according to the invention is close to an epicenter and the radiation pattern of the antenna having the assistance radiator (FIG. 7B) has an improvement of about 2~3 dB compared to the prior antenna (FIG. 7A) throughout the band.

As described above, the antenna of the mobile communication terminal having the assistance radiator according to the invention is easy to carry it due to the shortened length and can improve the property thereof.

In addition, the antenna of the mobile communication terminal having the assistance radiator according to the invention has a widened area corresponding to the end of the antenna, so that the average radiation gain of the antenna is not highly decreased even when a portion of the antenna is screened.

While the invention has been shown and described with reference to certain preferred embodiments thereof, it will be understood by those skilled in the art that various changes in form and details may be made therein without departing from the spirit and scope of the invention as defined by the appended claims.

What is claimed is:

1. An antenna of a mobile communication terminal comprising:

a dielectric;

a conductor line formed on the dielectric and having a leading end connected to a transceiving section of the mobile communication terminal and a terminal end extendingly formed into a shape curved from the leading end;

an assistance radiator electrically connected to the terminal end of the conductor line and mounted to surround a predetermined portion of the dielectric and the conductor line; and a housing which partially or completely covers the dielectric, the conductor line and the assistance radiator from the outside wherein the assistance radiator has two symmetrical surfaces and the dielectric is arranged between the two symmetrical surfaces.

2. The antenna of the mobile communication terminal as claimed in claim 1, wherein the conductor line is formed on a surface of the dielectric, and the assistance radiator is made of conductive material having a shape surrounding a predetermined portion of the dielectric and mounted to be spaced from the dielectric at a predetermined distance.

3. The antenna of the mobile communication terminal as claimed in claim 2, wherein the terminal end of the conductor line is formed with a through-hole passing through the dielectric, and an opened end of the assistance radiator comprises a connection piece passing through the through-hole to electrically connect with the terminal end of the conductor line.

4. An antenna of a mobile communication terminal comprising:

a dielectric;

a conductor line which is embedded in the dielectric to function as a radiator;

an assistance radiator electrically connected to the conductor line and mounted to surround a predetermined portion of the dielectric and the conductor line; and a housing which partially or completely covers the dielectric, the conductor line and the assistance radiator from the outside wherein the assistance radiator has two symmetrical surfaces and the dielectric is arranged between the two symmetrical surfaces.

5. The antenna of the mobile communication terminal as claimed in claim 4, wherein the terminal end of the conductor line is exposed to an exterior by a hole formed on a surface of the dielectric, and an opened end of the assistance radiator comprises a connection piece inserted into the hole to electrically connect with the terminal end of the conductor line.

6. The antenna of the mobile communication terminal as claimed in claim 4, wherein the assistance radiator is removably mounted on the dielectric.

7. A mobile communication terminal having an antenna, wherein the antenna comprises a dielectric; a conductor line which is embedded in the dielectric to function as a radiator; an assistance radiator electrically connected to the conductor line and mounted to surround a predetermined portion of the dielectric and the conductor line; and a housing which partially or completely covers the dielectric, the conductor line and the assistance radiator from the outside wherein the assistance radiator has two symmetrical surfaces and the dielectric is arranged between the two symmetrical surfaces.

* * * * *